United States Patent [19]

Yokoi

[11] 4,268,036

[45] May 19, 1981

[54] SHOOTING GAME APPARATUS

[75] Inventor: Gunpei Yokoi, Kyoto, Japan

[73] Assignee: Nintendo Company Limited, Kyoto, Japan

[21] Appl. No.: 23,893

[22] Filed: Mar. 26, 1979

[30] Foreign Application Priority Data

| | | | |
|---|---|---|---|
| Apr. 20, 1978 | [JP] | Japan | 53-047325 |
| Apr. 20, 1978 | [JP] | Japan | 53-047326 |
| Apr. 29, 1978 | [JP] | Japan | 53-051869 |
| Apr. 29, 1978 | [JP] | Japan | 53-059077[U] |

[51] Int. Cl.[3] ..... A63F 9/02

[52] U.S. Cl. ..... 273/316

[58] Field of Search ..... 273/101.1, 101.2, 316

[56] References Cited

U.S. PATENT DOCUMENTS

| | | | |
|---|---|---|---|
| 3,635,477 | 1/1972 | Ochi | 273/101.2 |
| 3,790,172 | 2/1974 | Nakamura | 273/101.2 |
| 3,904,204 | 9/1975 | Yokoi | 273/101.1 |
| 3,990,704 | 11/1976 | Meyer et al. | 273/101.2 |

FOREIGN PATENT DOCUMENTS

| | | | |
|---|---|---|---|
| 482171 | 12/1975 | U.S.S.R. | 273/101.2 |

*Primary Examiner*—Anton O. Oechsle

*Attorney, Agent, or Firm*—Koda and Androlia

[57] ABSTRACT

A shooting game apparatus to project a target and a pair of bullets on a screen. Upon firing a gun, a pair of bullets will move on the screen toward the target giving a feeling of real air fights. The apparatus comprises a housing, a light source disposed in the house, a pair of bullet forming units placed in the sides of said light source in a symmetrical fashion including a bullet slit, a mirror and a lense, said units being rotatable around said light source in said housing, and a means for driving said units rotating around said light source, whereby a pair of bullets are projected and moved on a screen in a symmetrical fashion.

3 Claims, 21 Drawing Figures

SHOOTING GAME APPARATUS

BACKGROUND OF THE INVENTION

1. Field of Invention

This invention relates to a shooting game apparatus and more particularly to a shooting game apparatus having a bullet projecting device and a target projecting device.

2. Prior Art

There has been known a shooting game apparatus such as U.S. Pat. No. 2,406,574 and U.S. Pat. No. 2,442,240. In the prior art apparatus, a light beam from the gun passed through a slit having a bullet-like shape is reflected with a mirror to be projected on a screen and is moved on the screen by changing the angle of the mirror. However, there is projected one single bullet track on the screen. Therefore, it is limited to a simple shooting game apparatus with one gun, and there are no teachings of any applicability to a rather complex apparatus such as air fights, and tank fights where a pair of guns are provided in both sides of a shooting device allowing the player to shoot the two guns at the same time whereby there are projected two bullet tracks on the screen. Further, the prior art apparatus is equipped with a separate light source for the bullet projecting device and the target projecting device, which made the structure of the apparatus complex and costly. Accordingly, the prior art apparatus may be used for real shooting practice, but is too costly for a commercial shooting game apparatus for leisure purposes.

SUMMARY OF THE INVENTION

Accordingly, it is the primary object of this invention to provide a shooting game apparatus which has a pair of guns in both sides of a shooting device allowing a player to shoot the guns at a target at the same time whereby a pair of bullet images are projected on a screen.

It is another object of this invention to provide a shooting game apparatus wherein the bullets will move on the screen in such a manner that the bullets express the distance to the target by changing the image thereof while moving on the screen.

It is still another object of this invention to provide a shooting game apparatus wherein not only the bullet's image moves on the screen but also the target's image, with only one light source for both images, whereby reducing the production cost to meet the commercial requirements for leisure purposes.

It is still another object of this invention to provide a shooting game apparatus wherein the whole screen is utilized by projecting a target, bullets, and moving part of the back scene, such as clouds, separately with a small size projector having a small capacity light source without using a large capacity projector.

It is still another object of this invention to provide a shooting game apparatus having a pair of bullet projecting units in a symmetrical position rotatable around a light source comprising a bullet beam slit, a mirror, and a lense, wherein a pair of bullet beams are projected on a screen by rotating the units around the light source in a symmetrical manner.

It is still another object of this invention to provide a shooting game apparatus, wherein a bullet beam slit to form the shape of the bullet projected on a screen has a slim triangular shape and there is provided an intercepting plate to move from the bottom toward the top of the triangle such that the intercepting plate has logarithm-like movement thereby changing the shape of the bullet as projected on the screen to look like a rocket bomb.

It is still another object of this invention to provide a shooting game apparatus having a unit for forming and moving a bullet image comprising a light source, a bullet beam slit and a mirror, said mirror being rotatably mounted to face the light source and the screen and getting the bullet image to move on the screen by changing its angle and a unit for forming and moving target image comprising target beam generating means, and a mirror, said mirror being rotatably mounted to face the light source and the screen and to get the target image to move on the screen by changing its angle, whereby the bullet image and the target image can move independently by using a common light source.

It is still another object of this invention to provide a shooting game apparatus wherein a third image projecting means for changing the back scene, such as clouds, is provided by using the common light source.

DETAILED DESCRIPTION OF THE INVENTION

Figure 1:
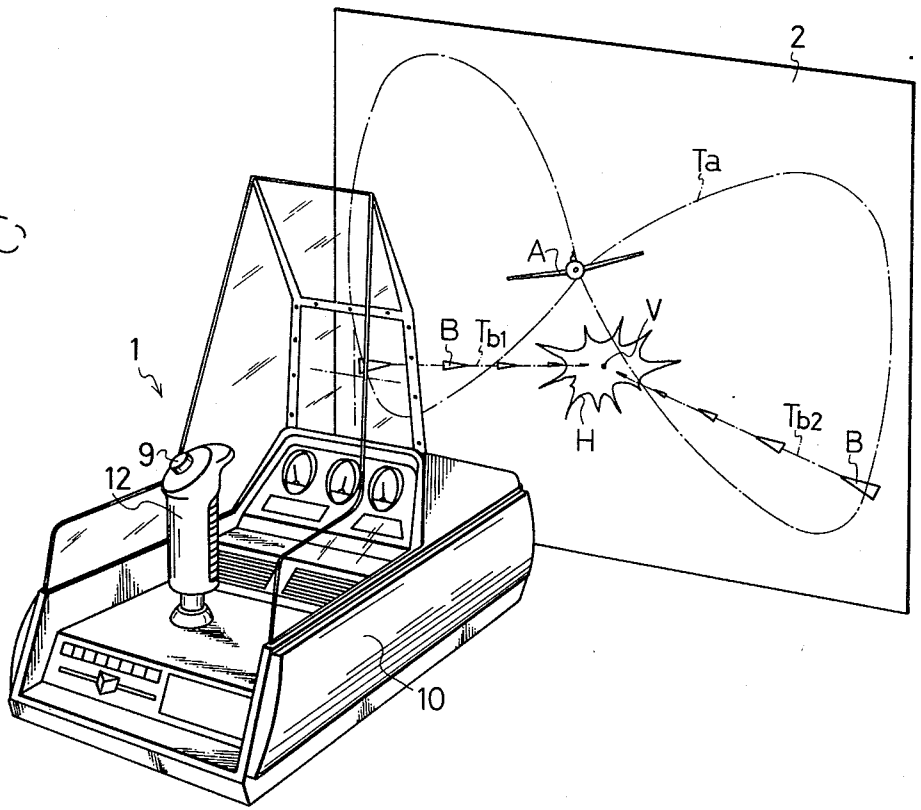
FIG. 1 shows a perspective view of an embodiment of the shooting game apparatus of this invention.
Figure 2:
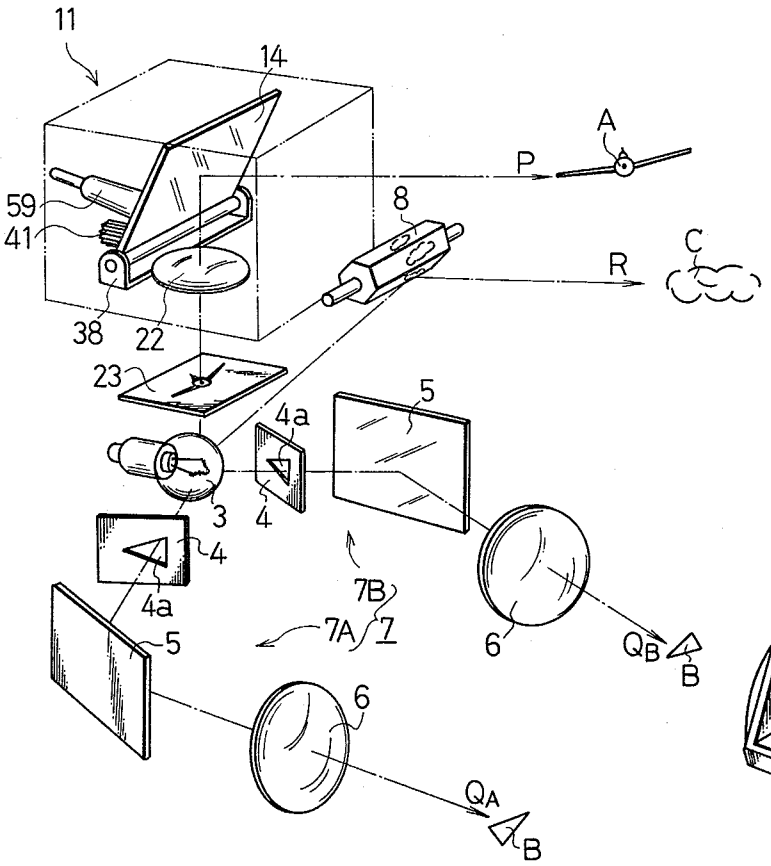
FIG. 2 shows an exploded view of a bullet image projecting device and a target image projecting device.

Referring to FIGS. 1 and 2, a projector-type shooting game apparatus 1 is facing a screen 2 wherein target beam P, bullet beam Q and back scene beam R are emitted from the apparatus 1 onto the screen 2 to project a target T such as an airplane, a bullet B such as a rocket bomb, and a hit sign H. Ta designates a regular orbit for the target T, and $Tb_1$ and $Tb_2$ designates the trace of the bullets B.

The shooting game apparatus 1 has, in a housing 10, a pair of bullet image forming units 7A and 7B comprising a light source 3, a slit 4 for bullets, a mirror 5 for bullets, and a lense 6 for bullets, a pair of symmetrical bullet projecting devices 7, a third image projecting means 8 (a rotatable polygonal cylindrical mirror) for providing third image beam R to project moving portion of the back scene, such as clouds C, and a target forming and controlling device 11. The housing 10 has a lever 12 extending therefrom. 9 designates a shooting button for firing bullet beam Q.

Now referring to FIGS. 3–6, the target forming and controlling device 11 comprises a driving means container 13 coupled to a plate 10*a* attached to the housing 10 as an integral unit, a mirror 14, a mirror controlling means in the horizontal direction 15, and a mirror controlling means in the longitudinal direction 16, thereby allowing the mirror 14 to freely change its angle both in the horizontal and longitudinal direction.

In the driving means container 13, there is provided a driving mechanism 21 comprising an electric motor 17, a decelerating mechanism 18, a horizontal driving mechanism 19, and a longitudinal driving mechanism 20.

In front of the driving means container 13, there are provided a target lense 22, a target forming means 23 (target slit plate), a shutter plate 24, where the target slit plate 23 is provided with a target mark 25 and a hit mark 26 by way of an opening or a transparent portion. The base of the target slit plate 23 and the shutter plate 24 are loosely coupled to shafts 27 and 28 respectively and held with a slip mechanism 30 comprising fasteners 29*a* and 29*b*, washers 31, and loaded springs 32, whereby the target slit plate 23 and the shutter plate 24 are rotatably connected to the shafts 27 and 28. Since the shaft 28 is decelerated by decelerating mechanism 18 and therefore, has less revolution than the shaft 27, the hit mark 26 takes the place of the target mark 25 between the lamp 3 and the mirror 14 due to rotation of the target slit plate 23, when the target is hit and a hit detecting mechanism 60 gives a signal to the electric motor 17 for reverse rotation. Thus, a hit mark H is projected on the screen 2 instead of the target mark T. After a moment, the shutter plate 24 will close the light and the hit mark H on the screen will disappear.

Figure 4:
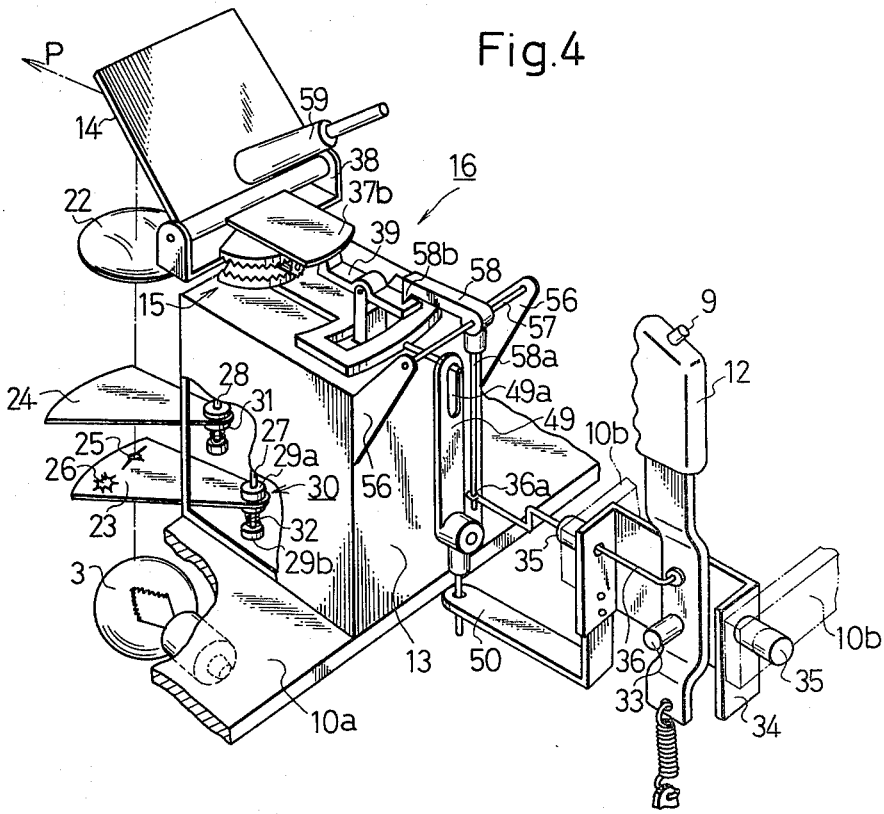
FIG. 4 shows a perspective view of a part of the image projecting device in FIG. 3.
Figure 5:
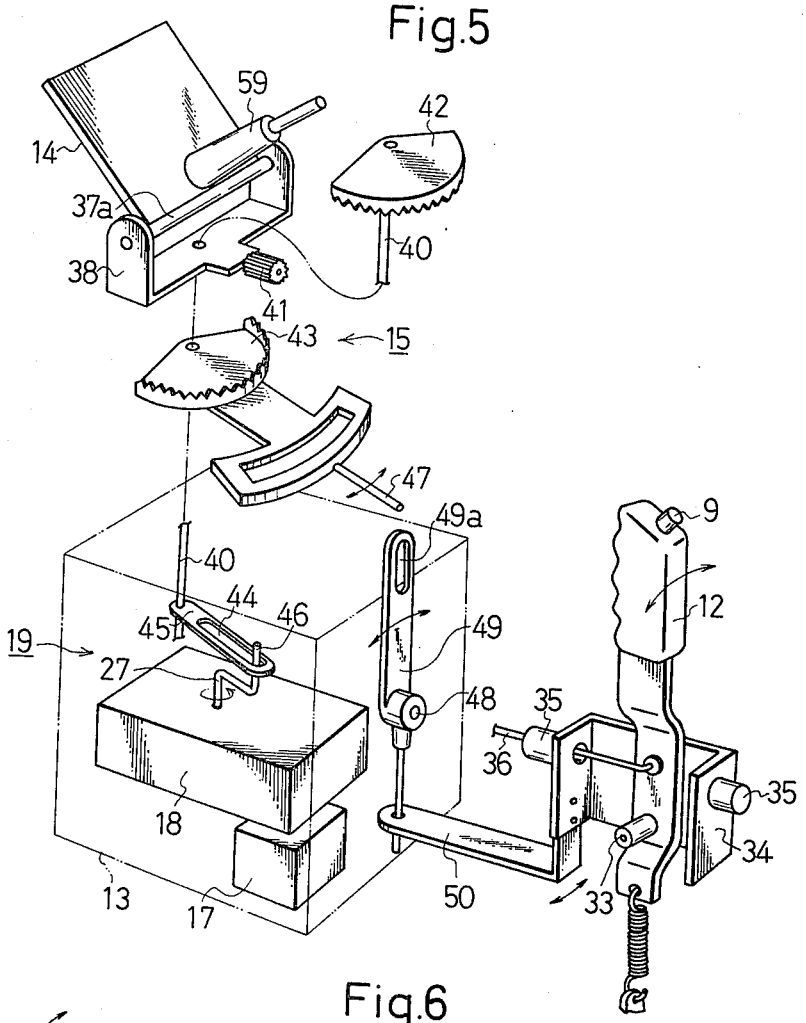
FIG. 5 shows an exploded view of a horizontal mirror rotating mechanism.

In FIGS. 4 and 5, the lever 12 is held by a shaft 35 fixed to a lever holding case 34 and supported by a supporting plate 10*b* coupled to the housing 10*a* an integral unit such that the lever is rotatable in the horizontal direction; further the lever 12 is held by a shaft 33 fixed to the case 34 as to be rotatable in the longitudinal direction.

Figure 3:
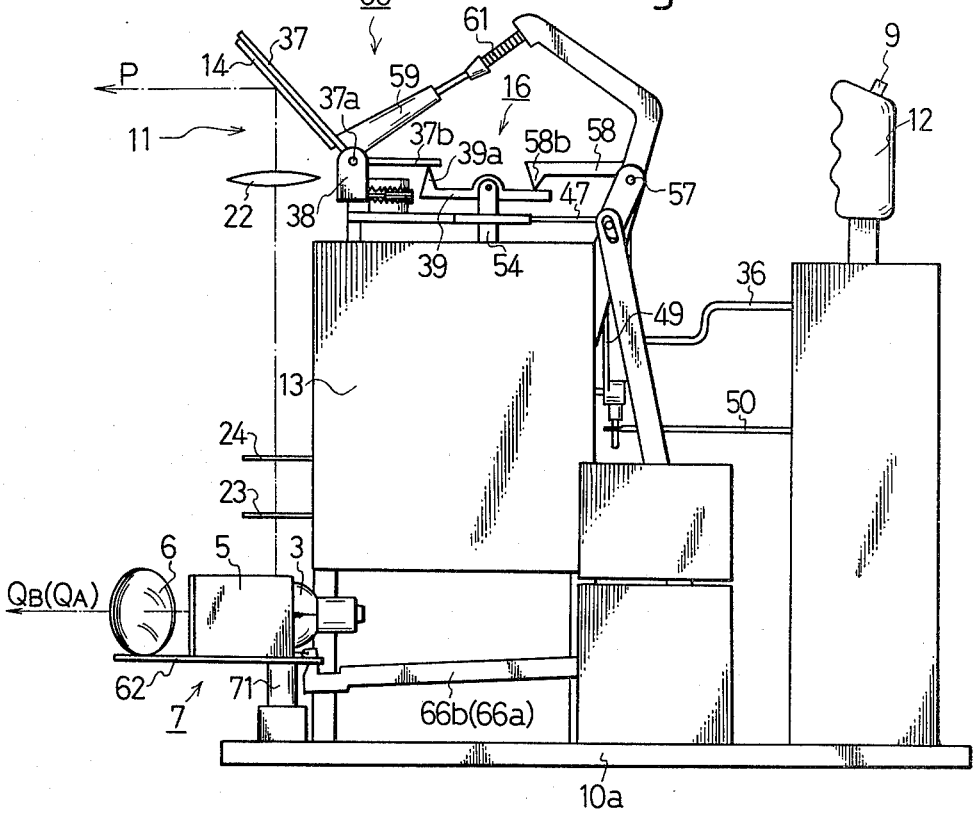
FIG. 3 shows a side elevational view of an image projecting device including a hit detecting means.

In FIG. 3, the mirror 14 is coupled to a mirror supporting base 37 connected to a shaft 37*a* which is rotatably held by a mirror stand 38 such that the mirror 14 is rotatable in the longitudinal direction. The shaft 37*a* has an extension 37*b* which is kept in contact with a projection 39*a* of a joint bar 39 wherein the mirror 14 can be rotated by elevating the projection 39*a*, thereby constituting a longitudinal mirror rotating means 16.

In FIG. 5, the mirror stand 38 is loosely held by a shaft 40 as to be rotatable in the horizontal direction. The mirror stand 38 is provided with a pinion 41 which is sandwiched by a first sector type bevel gear 42 fixed to the upper part of the shaft 40 and a second sector-type bevel gear 43 rotatably applied to the shaft 40 in the horizontal direction, wherein the mirror 14 can be rotated in the horizontal direction by rotating either the first or the second gear, thereby constituting a horizontal mirror rotating means 15.

As shown in FIG. 5, the shaft 40 is provided with an arm 45 with a long opening 44 at the bottom portion thereof, and a crank 46 formed at the top of a shaft in a decelerating mechanism 18, such as the shaft 27 is inserted into the long opening 44, whereby the bevel gear 42 can be rotated in the horizontal direction by rotating the shaft 27 causing rotation of the arm, whereby constituting a driving means 19 for moving the mirror 14 in the horizontal direction.

A transverse shaft 47 to rotate with the second sector bevel gear 43 is engaged with the long opening 49*a* wherein the rotation of the lever 12 is transferred to the bevel gear 43 through a longitudinal lever 49 pivotally held by the driving means container 13 and a transverse lever 50 fixed to the bottom portion of the lever holding case 34, whereby providing a means for connecting the lever 12 to the horizontal mirror rotating means 15.

Figure 6:
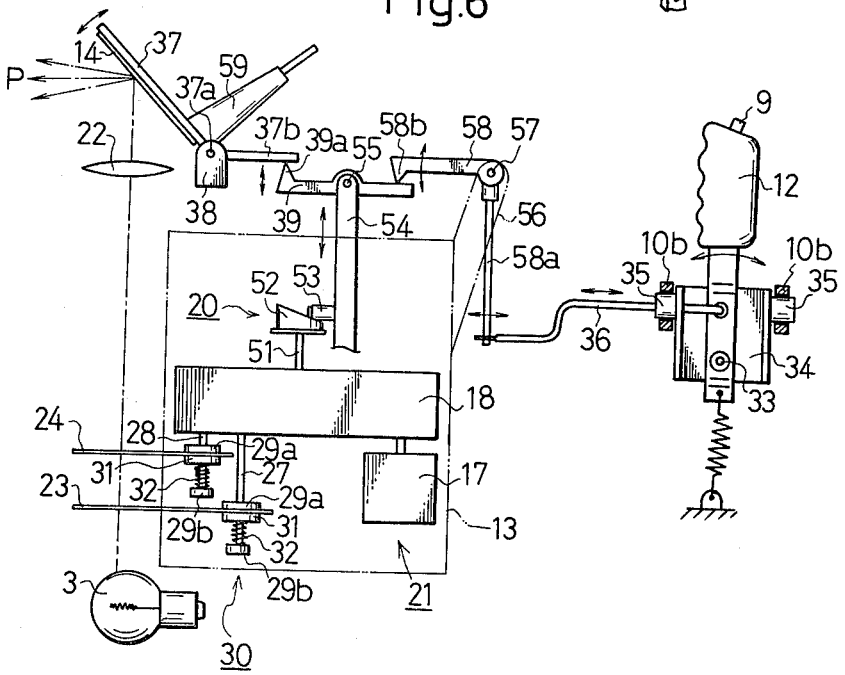
FIG. 6 shows an exploded view of a longitudinal mirror rotating mechanism.

Referring to FIG. 6, a cam 52 (a cylinder cut through diagonally to have an oval shape) is provided at the upper portion of a cam shaft 51 of the decelerating mechanism 18 and is kept in contact with a roller 53, and a stroke arm 54 to have a longitudinal movement according to the rotation of the cam shaft 51 and is engaged with a central portion of the joint bar 39 at the upper part thereof, whereby the projection 39*a* moves in the longitudinal direction due to the movement of the stroke arm 54 causing the mirror to rotate in the longitudinal direction thereby constituting a longitudinal mirror rotating means 20.

The driving means container 13 has a supporting bar 56 extending therefrom to which a push arm 58 is pivotally connected, wherein a projection 58*b* formed at the tip of the push arm 58 is kept in contact with the bottom portion of the joint bar 39. Further, a rod 58*a* extending downward from the push arm 58 is inserted into an opening 36*a* provided at the tip of the lever 36 to transform the back and forth movement of the lever 12 into the longitudinal movement of the projection 58*b*, thereby constituting a means for connecting the longitudinal rotation of the lever 12 and the longitudinal mirror rotating means 16.

Now referring back to FIG. 3, 59 designates a shooting point indicator extending from the rear of mirror 14, the shooting point indicator 59 is so set to face a sensor piece 61 when the mirror 14 comes to a position to project target beam from the light source 3 right at a shooting point V. Thus, upon making a hit, the indicator 59 comes to contact and pushes the sensor piece 61 causing the motor 17 to switch to reverse revolution, whereby constituting a hit sensor means 60.

Once the motor 17 is switched on to have a regular revolution, the target mark 25 of the target slit plate 23 is positioned at the top of the light source 3 so that target beam P is released to reach the screen 2 through the target lense 22 and the mirror 14 to project the target (airplane) A. As shown in FIG. 6, rotation of the cam shaft 51 causes longitudinal motion of the stroke arm 54 through the cam 52 and the roller 53, and the joint bar 39 moves up and down around the projection 58*b* causing the extension 37*b* to move up and down through the projection 39*a*. Thus, the mirror 14 rotates back and forth due to the horizontal mirror rotating means 15 and the horizontal mirror driving mechanism 19 to move the target A on the screen along the direction. At the same time, as shown in FIG. 5, rotation of the shaft 27 causes rotation of the pinion 41 through the crank 46, the arm 45, the shaft 40, the second bevel gear 43, and when the second bevel gear 43 is fixed, the first bevel gear 42 rotates back and forth up to a half of its maximum rotating angle around the shaft 40. Thus, the target A is moved on the screen along the X direction due to the longitudinal mirror rotating means 16 and the longitudinal mirror driving mechanism 20. As a result, the target A will have a track Ta similar to "8" on the screen 2.

The track Ta will vary with its configuration and starting point based upon the position of the crank 46 and the cam 27 at the time the motor 17 switches on for regular revolution. In the case of air fighting, a player may be instructed to adjust the lever 12 to place the target at a suggested point in the center of the screen 2 before he starts shooting in order that he is in a position to follow the target airplane A. By rotating the lever back and forth, the projection **58*b* moves up and down causing the joint bar 39 around the shaft 55 to result in longitudinal motion of the projection 39*a*. When the projection 58*b* has longitudinal motion commensurate in speed and direction with the existing motion of the projection 39*a* by the stroke arm 54, the mirror 14 stops its longitudinal motion. As shown in FIG. 5, by rotating the lever in the horizontal direction, the mirror stand 38 will rotate in the horizontal direction due to the rotation of the second bevel gear 43. When the second bevel gear 43 is rotated in a direction and speed commensurate with the existing rotation of the first bevel gear 42, the mirror 14** will stop its horizontal motion.

Accordingly, the rotation of the lever 12 and the motion of the target A have the following relation, which is similar to the action of a lever of a real airplane.

| Lever | Motion (direction) of Target |
|---|---|
| pull | down |
| push | up |
| right | left |
| left | right |

By adjusting the lever to get the target to draw, the "8" track on the screen 2, the player can place the target at the shooting point in the center of the screen 2.

When the target A is placed at the shooting point and the player pushes the button 9, the bullet B is projected on the screen 2 by the bullet projecting devices 7A and 7B. Upon hitting the target A, the motor 17 gets into reverse revolution causing the shafts 27 and 28 to reverse rotation upon receiving a signal from the sensing means 60. Due to the reverse rotation of the shaft 28, the target slit plate 23 will come to a "shut" position and a hit image H will be projected on the screen 2. Further, due to the reverse rotation of the shaft 27, the shutter plate 24 moves to a "shut" position to shut the target beam and cut the hit image H. Since the shaft 28 of the shutter plate 24 has a slower rotation speed than the shaft 27 of the target slit plate 23, the slit plate 23 rotates at first to change the target A to the hit image H, and then after a moment, the hit image H will disappear just as a real fight.

Figure 14:
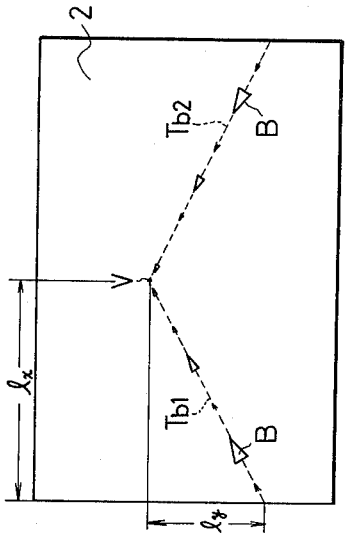
FIG. 14 shows an explanatory view of a screen with bullet images projected thereon.

As to the bullet projecting device, a pair of bullets (rocket bomb) are to be fired from both sides of an airplane to fight the target airplane T. As shown in FIG. 14, a pair of bullets B having a triangular shape move from the sides of the screen 2 toward the center.

Figure 7:
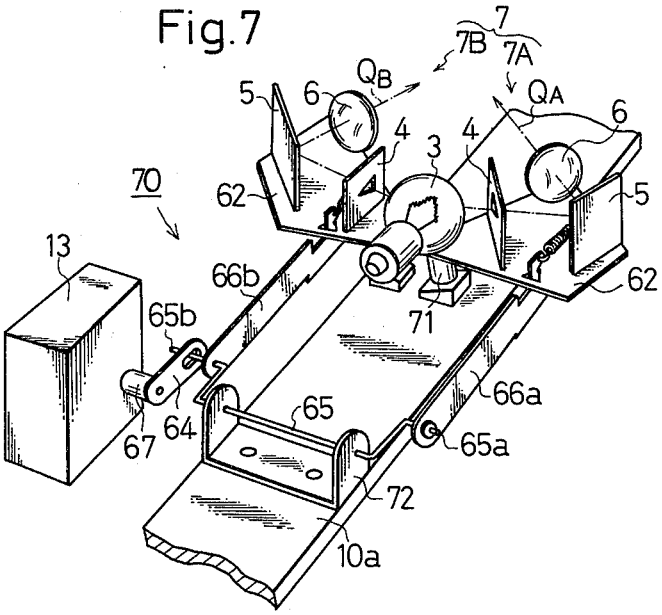
FIG. 7 shows a perspective view of a bullet image projecting device.
Figure 19:
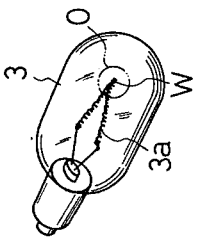
FIG. 19 shows a perspective view of a light source.

Referring to FIG. 7, in the housing 10, the bullet projecting device 7 comprises a pair of bullet forming units 7A and 7B rotatable around the light source 3, and a driving means 70. The light source 3 is fixed to the housing 10 through a socket (not shown) and a supporting plate (not shown), and the bullet forming units 7A and 7B are coupled to the plate **10*a* in the housing 10 through a supporting plate 62 and a supporting shaft 63 such that the units 7A and 7B are rotatable around the center of the light source. As shown in FIG. 19, the center of the light source 3** is the point where the brightness is the highest.

Figure 9:
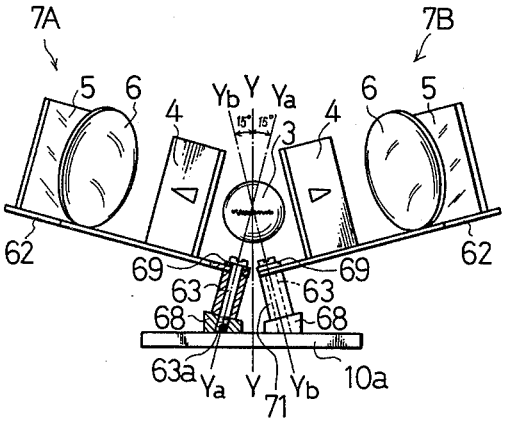
FIG. 9 shows a partial cross-sectional view of the bullet image projecting device.

Referring to FIG. 9, the supporting plate 62 is held by the supporting shaft 63, where a metal washer 68 is fixed to the plate **10*a* and a cylinder 71 is supporting the plate 62. The upper surface of the metal washer 63 is slanted so that the supporting shaft 63 (Ya—Ya) (Yb—Yb) is slanted to a certain angle (for example 15°) from the vertical axis Y—Y. Thus, the supporting plate 62 is held by the cylinder 71 which is loosely put around the supporting shaft 63, such that the supporting plate 62 has its outer portion slanted upward and is rotatable back and forth. Accordingly, by rotating the supporting plade 62, the bullets B on the screen 2 will move from both sides of the screen 2 toward the center of the screen 2** and as the bullets B come closer to each other, they move upward.

Referring to FIG. 7, the driving mechanism 70 for the bullet forming units 7A and 7B works as follows. The rotation of the output shaft 67 from the driving means container 13 causes the crank 65 rotatably mounted on a supporting fastner 72 fixed to the plate **10*a* to rotate through a driving arm 64. The rotation of the crank 65 further causes the supporting plate 62 to rotate, since the ends 65*a* and 65*b* of the crank 65 are connected to crank arms 66*a* and 65 which are coupled to the supporting plate 62 of the bullet forming units 7A and 7B. Thus, the beams at A and at B will rotate around the center point of the light source 3, said beams at A and at B being emitted from the light source 3 to the mirror 5 through the bullet slit 4**.

Figure 10:
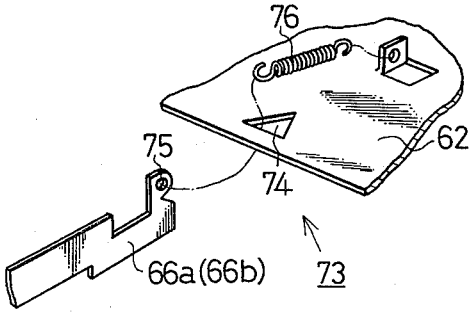
FIG. 10 shows an exploded view of a crank arm and a supporting plate.

The supporting plate 62 is slanted and the direction of the rotation of the supporting plate 62 and the supporting shaft 63 is different from that of the crank 65. Therefore, the crank arms **66*a* and 66*b* and the supporting plate 62 can be connected without having a play by using a connecting means 73 as shown in FIG. 10. The connecting means 73 allows the supporting plate 62 to move up and down without a play by keeping an engaging point 75 of the crank arms 66*a* and 66*b* in contact with a triangular opening 74 provided in the supporting plate 62**.

Figure 11:
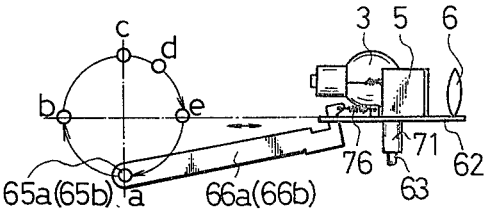
FIG. 11 shows a side elevational view of a driving mechanism for the bullet image projecting device.

The working parts **65*a* and 65*b* of the crank 65 rotate to make a circle track as a→b→c→d→e→a at a constant speed as shown in FIG. 11. The crank 65 is so designed that when the gun is fired, the working parts 65*a* and 65*b* are located at Point a, and when the bullets B disappear at the center of the screen 2, the working parts 65*a* and 65*b*** are located at an upper dead point B. Thus the moving speed of the bullets B has a logarithmetic-like change.

Figure 12:
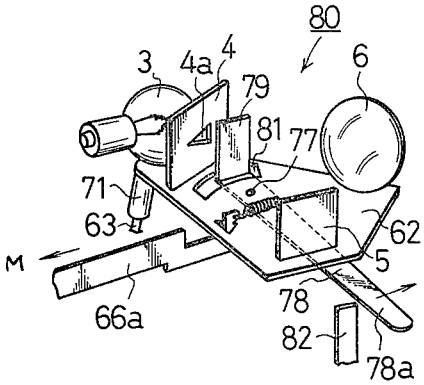
FIG. 12 shows a perspective view of a bullet image controlling means.
Figure 8:
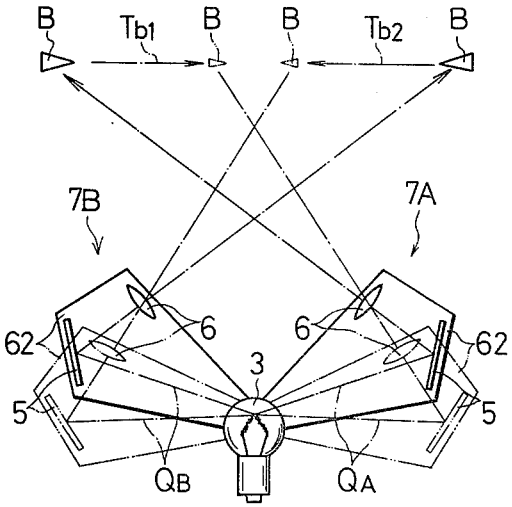
FIG. 8 shows an explanatory view of a bullet image projecting device.

In this embodiment, the bullet B has a rocket bomb-like configuration and is equipped with an iris means 80 to have such logarithmic changes as shown in FIG. 12.

The iris means 80 has an iris arm 78 in close contact with the supporting plate 62 such that the iris arm 78 is rotatable around an axis 77 fixed to the supporting plate 62 and is held with a spring (not shown). The iris arm 78 has an iris plate 79 extending upward from the edge of the iris arm 78 through a long slit 81 provided in the supporting plate 62, whereby, the iris plate 79 can move to open and shut the slit 4*a* provided in the bullet slit plate 4. Further there is provided an iris stopper 82 fixed to the plate 10*a* to stop and rotate the iris arm 78 about axis 77 when the crank arms 66*a* and 66*b* are moved toward the arrow M and move the plate 62. Thus, as shown in FIG. 13 due to the bullet slit 4 of the bullet forming units 7A and 7B and the iris plate 79 controlled by the stopper 82 acting on arm 78, the images of the bullets B will change their size logarithmically without changing their configuration.

Figure 13:
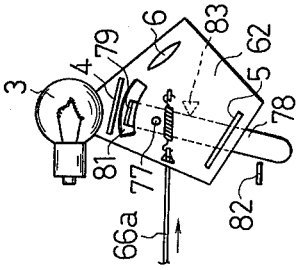
FIG. 13 shows a plan view of a light controlling means.

In FIG. 13, 83 designates a second stopper which acts on arm 78 to cause the iris plate 79 to return to an open position with a small stroke of the crank 65 from point d to point e, said stopper 83 being fixed to the plate 10*a* and extending therefrom.

Figure 17:
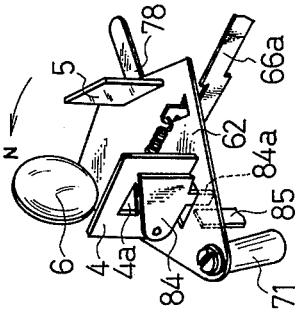
FIG. 17 shows a perspective view of a shutter means for controlling bullet images.
Figure 15:
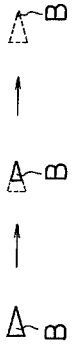
FIG. 15 shows an explanatory view of the bullet images in action.

In FIG. 17, 84 designates a shutter to prevent a bullet to be projected while the iris plate 79 is completely open. In this embodiment the shutter functions upon hitting a third stopper 85 whose extension 84*a* is projecting from the plate 10*a* while the crank 65 moves between point c and point e.

The bullet projecting device operates as follows: By pushing the shooting button 9, the driving means container 13 is caused to drive the working parts 65*a* and 65*b* of the crank 65 into a circle track as a→b→c→d→e, as is shown in FIG. 11. Thus, the crank arms 66*a* and 66*b* start piston motion.

Figure 18:
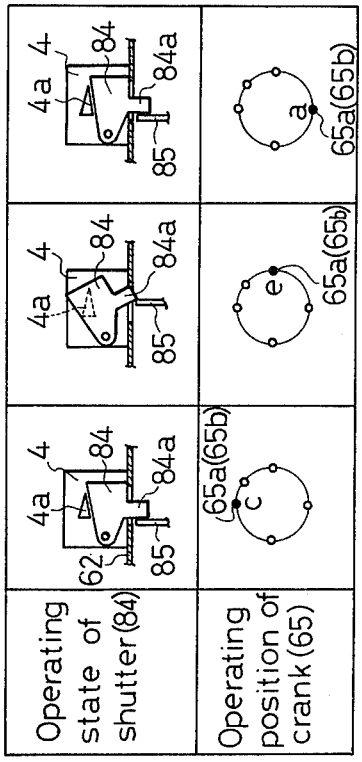
FIG. 18 shows schematic views of the operation of the shutter means.

With the piston motion of the crank arms 66*a* and 66*b*, the iris plate 79 is at a completely closed position due to friction with the supporting plate 62 when the crank moves from point b to point d. Even after the slit 4 has become completely open due to the function of the second stopper 83 at point d, the shutter 84 will keep the closed state until point a. As shown in FIG. 17 and 18, as the supporting plate 62 rotates toward the arrow N, the shutter 84 will move to the right-central position shown in FIG. 18 by the third stopper 85. As the supporting plate 62 rotates in the reverse direction, the shutter moves to a position shown in the right of FIG. 18, thereby closing the bullet beam. Accordingly, as the plate 62 rotates in the reverse direction, the bullet beam changes continuously from being completely open to being completely closed and back again as the crank 65 moves between point c and point a.

Figure 16:
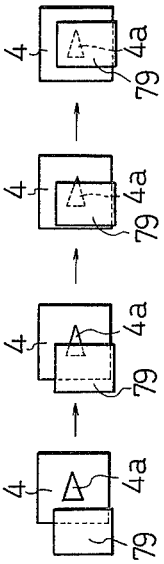
FIG. 16 shows an explanatory view of a bullet image controlling means.

Accordingly, as shown in FIG. 16, the slit 4*a* of the bullet slit plate 4 changes from the complete open state to a closing state gradually from point a to point b during one cycle of the crank 65. Since the motion of the crank arm 66 is slowing down logarithmically around the upper dead point b, the changes in the size of the slit 4*a* also get slower. The shaft 63 of the supporting plate 62 is slanted, the tracks Tb1 and Tb2 are constituted from a horizontal moving factor 1x and vertical moving factor ly as shown in FIG. 14.

In case the motor circuit is so designed to be closed for a period of time sufficient for the crank 65 to have one cycle upon pushing the shooting button, the shooting is a single shot. However, by incorporating a continuous relay to control the operating time while the shooting button is pushed, the shooting may become the continuous shot type, such as a machine gun.

A filament type electric bulb is used as the light source 3 where the filament 3*a* has a V-shape, and the top point W of the filament 3*a* is the center of the light which forms the beam P to pass through the target slit 23 and the beam P to pass through the bullet slit 4. Therefore, the slits 4 and 23 are so positioned to properly face the circle O around the top point of the filament 3*a* for catching the maximum brightness.

Thus, the bullet beam and the target beam P will obtain highest possible brightness and cast a clear image on the screen Z.

In general, it is required to use a filament which is bright but short enough. To satisfy the above condition, low voltage standard lamps (12 V, 24 V, etc.) seem appropriate. However, a transformer with 3.3 A capacity or more is required to get a low voltage standard lamp, for example, 12 V 40 W to function properly which will cost too expensive as a part of a toy. However, in this invention, since the practical source of light is concentrated on the top point W of the filament 3*a*, any commercially available regular lamps can be used such as AC100 V, 40 W.

Figures 20A, 20B:
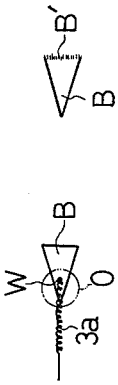
FIG. 20 A and B shows an explanatory view of a light source and a shape of a bullet as projected.

Further, as long as the top point W is used as concentrated light source and the slit plate 4 has a horizontally lengthy triangular slit 4*a* to project a bullet with a rocket bomb image, the track makes a bullet's tail B to give an impression of tow-bomb as shown in FIG. 20B.

In the embodiment, since only a target mirror 14 is rotated instead of a conventional target forming case equipped with a mirror, the load upon the motor 17 is low. Even a 1.5 V motor will suffice. Since the motor speed is slow, the motor 17 will have a longer life, less noise, and the decelerating mechanism can be simplified.

According to this invention, since there are provided a pair of bullet forming units in both sides of a light source to get a pair of bullets move from the sides toward the center of a screen, a player can enjoy the feeling of a real airplane fight by shooting guns from both sides of his plane to attack a target airplane.

The second feature of this invention is that since the supporting shaft of the bullet forming units is slanted, and the light source is located at the crossing of extensions from the shaft, the axis of the bullet beam runs across the center of the rotation of the bullet forming units, whereby the amount of light that the bullet beam contains can be constant and the tracks of the bullets can attain vertical moving factors.

The third feature of this invention is that since the bullet will disappear when the crank reaches around the upper dead point, the bullet has logarithmic changes on the screen giving a feeling of a real airplane fighting.

The fourth feature of this invention is that the bullet slit has a triangular shape and the shutter moves from the bottom toward the top whereby the bullet changes its configuration logarithmically like a real rocket bomb.

The fifth feature of this invention is that the target beam and the bullet beam are cast on the screen through separate rotatable mirrors with a common light source, thereby producing same effects as two separate projecting machine, which results in lower cost.

The sixth feature of this invention is that since the top point of the filament is located at the crossing of the target beam and the bullet beam, the images on the screen attain the highest brightness, whereby any commercially available electric bulbs can be used.

The seventh feature of this invention is that the bullet beam, the target beam and the third beam for the back scene can be generated with a common light source such that the three types of beam can move on the screen freely and independently, thereby reducing the production and operation cost without losing the quality.

I claim:

1. A bullet image projecting device comprising:

a housing:

a light source disposed in said housing;

a pair of bullet image forming units placed at generally opposing sides of said light source in a symmetrical fashion, each unit including a bullet slit, a mirror and a lense, said unit being rotatable around said light source in said housing, and a means for rotating said unit cojointly around said light source, whereby a pair of bullet image are projected and moved on a screen in a symmetrical fashion.

2. A bullet image projecting device comprising, a housing, a light source disposed in said housing, a pair of bullet image forming units placed at generally opposing sides of said light source in a symmetrical fashion, each unit including a bullet slit, a mirror and a lense, said unit being rotatable around said light source in said housing and a means for rotating said units cojointly around said light source, wherein imaginary extensions of supporting shafts for each one of said units cross each other at the center of said light source, and beam lines from each one of said units cross each other at the center of rotation of said units, thereby providing horizontal and vertical motion factors to tracks of the bullet images as projected on said screen.

3. A bullet image projecting device according to claim 1 or 2 wherein said means is so arranged that a crank shaft to be rotated by a driving unit and a working part of a crank to rotate said bullet image forming units with one end thereof are pivotally connected to each other at around an upper dead point of the rotation of said crank when bullet images disappear, thereby causing the bullet images to have the slowest speed before their disappearance.

* * * * *